US010398232B2

(12) United States Patent
Limpaitoon

(10) Patent No.: US 10,398,232 B2
(45) Date of Patent: Sep. 3, 2019

(54) SEAT CUSHION

(71) Applicant: Tongchai Limpaitoon, Muang Samutprakarn (TH)

(72) Inventor: Tongchai Limpaitoon, Muang Samutprakarn (TH)

( * ) Notice: Subject to any disclaimer, the term of this patent is extended or adjusted under 35 U.S.C. 154(b) by 0 days.

(21) Appl. No.: 15/868,407

(22) Filed: Jan. 11, 2018

(65) Prior Publication Data

US 2018/0199720 A1 Jul. 19, 2018

(30) Foreign Application Priority Data

Jan. 13, 2017 (TH) ..... 1701000186

(51) Int. Cl.
*A47C 7/02* (2006.01)
*A47C 7/14* (2006.01)
*A47C 31/12* (2006.01)

(52) U.S. Cl.
CPC ..... *A47C 7/021* (2013.01); *A47C 7/029* (2018.08); *A47C 7/14* (2013.01); *A47C 31/126* (2013.01)

(58) Field of Classification Search
None
See application file for complete search history.

(56) References Cited

U.S. PATENT DOCUMENTS 3,781,931 A * 1/1974 Knickerbocker .... A47C 27/081 297/DIG. 3
4,445,240 A * 5/1984 Voorhees ..... A47C 4/54 5/654
4,724,560 A * 2/1988 Christie ..... A47C 27/081 5/644
4,737,999 A * 4/1988 Halverson ..... A47C 20/025 5/710
4,865,388 A * 9/1989 Nemoto ..... B60N 2/888 297/403
5,046,205 A * 9/1991 Garcia ..... A47C 7/021 4/456
5,070,559 A * 12/1991 Pettifer ..... A47C 20/027 5/655.3
5,121,962 A * 6/1992 Weber ..... A41D 19/01523 297/199
5,619,757 A * 4/1997 Baratta ..... A47K 13/06 4/239
6,241,320 B1 * 6/2001 Chew ..... A47C 7/021 297/452.26
6,415,467 B1 * 7/2002 Bretvin ..... A47C 4/54 5/710
2005/0121957 A1 * 6/2005 Matsushima ..... A47C 27/00 297/284.5
2006/0022506 A1 * 2/2006 Chan ..... A47C 7/282 297/452.63
2007/0204406 A1 * 9/2007 Thisse ..... A47C 7/021 5/655.3

(Continued)

*Primary Examiner* — David E Allred
(74) *Attorney, Agent, or Firm* — Kim IP Law Group PLLC

(57) ABSTRACT

A seat cushion according to the present invention is configured as a fluid or gas containing bag. When weight of buttocks are transferred back and forth in left, right, front, rear directions, the fluid or gas contained therein will be transferred back and forth. The level of the fluid or gas contained in the seat cushion is defined by the manufacturer which is 5-40 millimeters. The fluid or gas is detained inside in use. The seat cushion can be laid on cushion of different seats and on the floor.

9 Claims, 3 Drawing Sheets

(56) References Cited

U.S. PATENT DOCUMENTS

| | | | | |
|---|---|---|---|---|
| 2007/0236074 | A1* | 10/2007 | Rodriquez, Jr. ..... | A47C 7/021<br>297/452.41 |
| 2013/0270881 | A1* | 10/2013 | Fowler ..... | A61G 7/1023<br>297/219.1 |
| 2017/0008249 | A1* | 1/2017 | Parsons ..... | A41D 31/28 |
| 2018/0271302 | A1* | 9/2018 | Volla ..... | A47C 27/081 |

* cited by examiner

SEAT CUSHION

CROSS-REFERENCE TO RELATED APPLICATIONS

This application claims foreign priority, pursuant to 35 U.S.C. § 119, to Thai Patent Application No. 1701000186, filed Jan. 13, 2017, the entire disclosure of which, is incorporated by reference herein in its entirety.

FIELD OF THE INVENTION

The present invention relates to a seat cushion.

The present invention is designed using engineering involving back and forth circulation and transfer of fluid or gas within a fluid or gas containing bag. Body weight of a person applied on different portions of fluid or gas containing chamber rises or lowers the seat cushion which supports the hip and coccyx such that the correct sitting posture is formed and lower back muscles are exercised.

BACKGROUND OF THE INVENTION

The conventional seat cushions are configured into sheets of different shapes having different seat heights filled with sponge, foam, synthetic fiber, or other solid materials. When different weights are applied on the seat cushion, it will be leveled equally across the sheet.

In the seat cushion according to the present invention, when body weight is transferred back and forth, the amount of fluid or gas contained therein which defines thickness of the seat cushion will be transferred back and forth which results in a continuous movement of muscles connected to the hip, coccyx and lower intervertebral discs for highest benefit of the user.

SUMMARY OF THE INVENTION

Seat cushion according to the present invention is configured as a big fluid or gas containing bag containing fluid or gas. When weight of the hip or thighs is transferred back and forth in different directions, the fluid or gas contained in the seat cushion will in turn be transferred back and forth in the bag containing fluid or gas in order to enable free movements of muscles of coccyx and intervertebral discs and to support all hip movements so that the hip can be moved naturally which results in a continuous and smooth movement of the back and a reduced pressure on the intervertebral discs which reduces fatigue.

The main objective is to provide a cushion for supporting the curvatures of muscles of hip and coccyx using air or fluid system based on fluid or gas transfer which can be laid on a chair or a seat for convenient use on an office chair, a couch, an airplane seat, or on the floor.

DETAILED DESCRIPTION OF THE INVENTION

Figure 1:
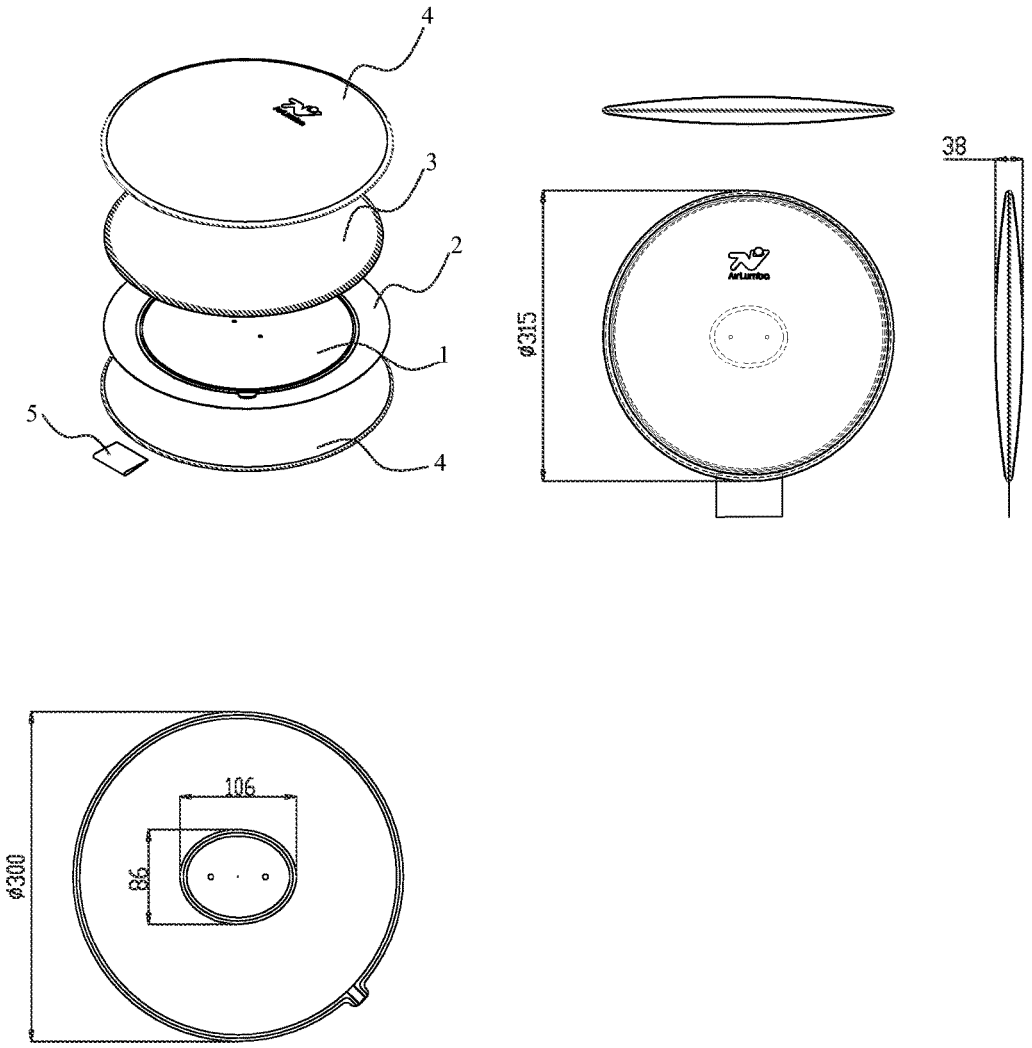
FIG. 1 shows partial cross-sections of the seat cushion

The seat cushion according to the present invention is characterized in that:

In FIG. 1, the seat cushion has a circular shape with a diameter of 315 millimeters, a fluid or gas containing bag (1) having a circular shape with a diameter of 300 millimeters being disposed inside having a small oval with a width of 86 millimeters and a length of 106 millimeters on its center for compartmentalizing the fluid or gas containing bag for supporting hip and thigh from the fluid or gas containing bag (1). Fluid or gas is filled in the fluid or gas containing bag (1) to a level of 5-40 millimeters, the fluid or gas containing bag (1) is sewn to a fabric sheet (2) for firmly fixing the fluid or gas containing bag (1) in a cover fabric (4), the edges of the fabric sheet (2) is sewn to the peripheral edges of the cover fabric (4) with a space of 14 centimeters, the cover fabric (4) is then flipped such that the fluid or gas containing bag (1) is disposed inside the cover fabric (4), sponge pad (3) is inserted between the fluid or gas containing bag (1) and the cover fabric (4) for additional softness on the contact surface in use, a product label (5) is sewn thereto, and the gap on the lower edge of the fabric of the product is closed.

Figure 2:
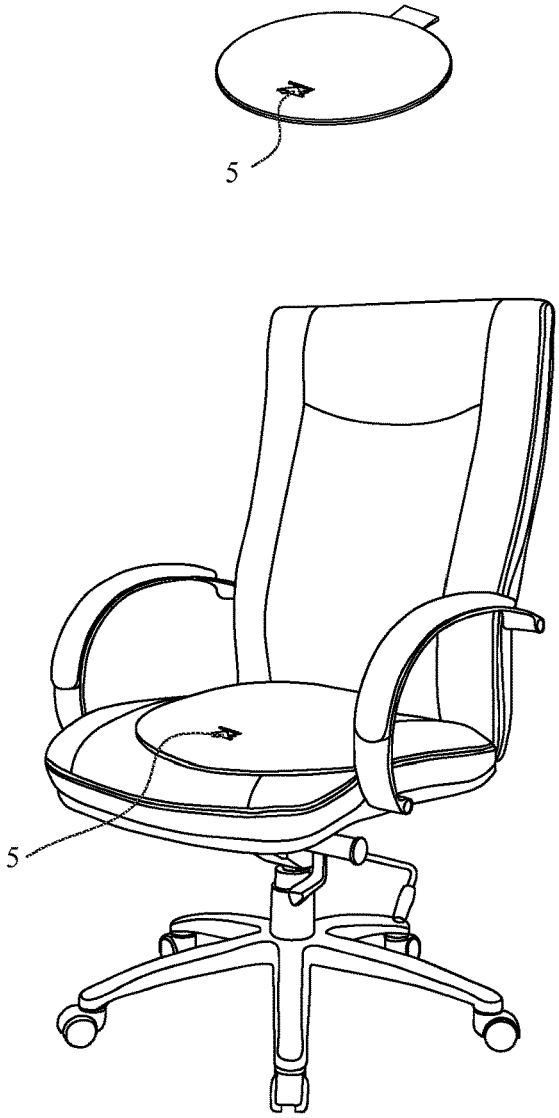
FIG. 2 shows attachment of the seat cushion to a cushion of a chair.

FIG. 2 shows attachment of the seat cushion to a cushion of a chair wherein the product label (5) is positioned at the back toward the backrest of the chair.

Figure 3:
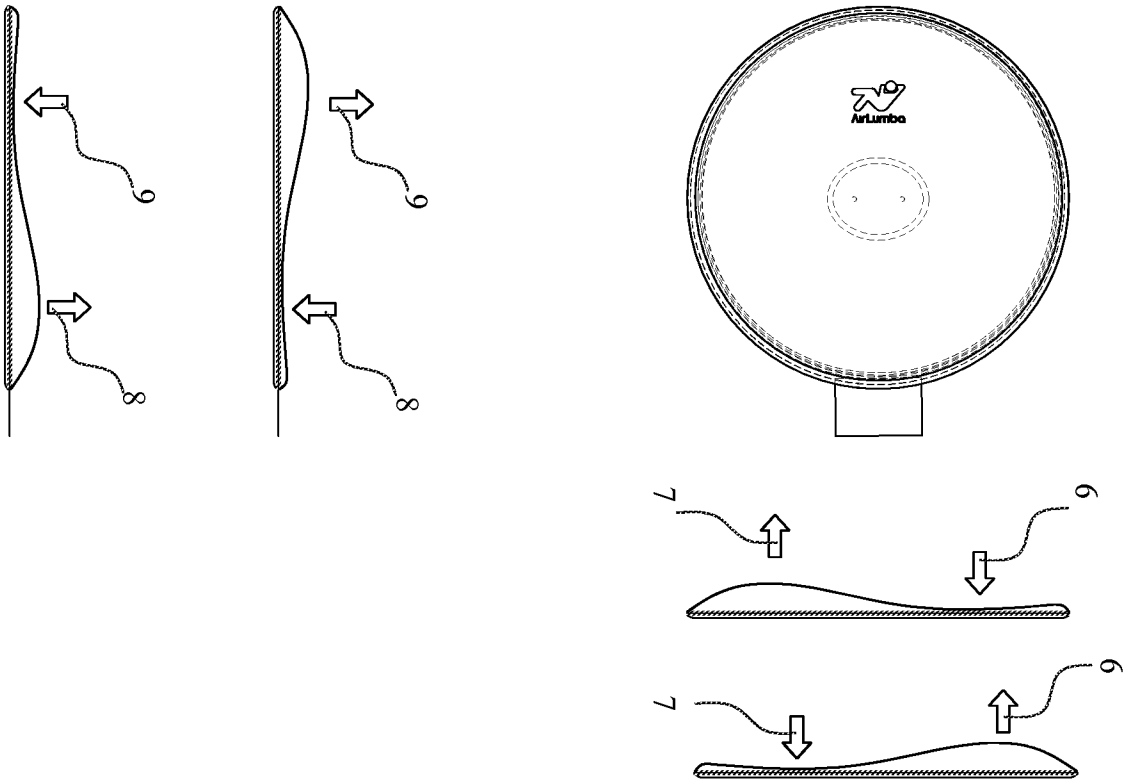
FIG. 3 shows air transfer inside the seat cushion upon a weight transfer.

In FIG. 3, when the seat cushion is in suitable position and a user sits such that buttocks was laid on the seat cushion wherein the right buttock presses the right side of the seat cushion (6) and the left buttock presses the left side of the seat cushion (7), if more weight is applied from the right buttock, the fluid or gas in the right portion will be transferred to the left portion such that the height of the right side of the seat cushion (6) is lowered and the height of the left side of the seat cushion (7) is increased, if more weight is applied on the left side, the fluid or gas in the left portion will be transferred to the right portion such that the height of the left side of the seat cushion (7) is lowered and the height of the right side of the seat cushion (6) is increased, if more weight is applied from the rear of the buttocks, the fluid or gas in the rear portion will be transferred to the front portion such that the height of the rear side of the seat cushion (8) is lowered and the height of the front side of the seat cushion (9) is increased, and if more weight is applied from the front of the buttock, the fluid or gas in the front portion will be transferred to the rear portion such that the height of the front side of the seat cushion (9) is lowered and the height of the rear side of the seat cushion (8) is increased. The transfer of fluid or gas from the left portion to the right portion, from the right portion to the left portion, from the front portion to the rear portion, and from the rear portion to the front portion result in movements of the muscles of hip, coccyx, and lower intervertebral discs in the direction of the fluid or gas contained in the seat cushion which exercise the muscles of hip, coccyx, and lower intervertebral discs in order to reduce fatigue.

The invention claimed is:

1. A seat cushion comprising a circular shape containing therein a fluid or gas containing bag that includes an oval shaped compartment disposed therein on a center of the fluid or gas containing bag, the compartment compartmentalizing the fluid or gas containing bag for supporting a user hip or thigh; a top fabric sheet;

a bottom fabric sheet;

a central fabric sheet; and a sponge pad, wherein the fluid containing bag is concentrically sewn to the central fabric sheet; and the sponge pad is layered between the fluid containing bag and one of the top and bottom fabric sheets.

2. A seat cushion according to claim 1, laid on a cushion of a different seat and/or on the floor.

3. A seat cushion according to claim 1, wherein the fluid or gas contained therein includes air, oxygen, and/or nitrogen.

4. A seat cushion according to claim 1, wherein the fluid or gas containing bag has a diameter of about 300 millimeters.

5. A seat cushion according to claim 1, wherein the oval shaped compartment has a width of about 86 millimeters and a length of about 106 millimeters.

6. A seat cushion according to claim 1, wherein the fluid or gas containing bag includes a fluid or gas filled to a level of about 5-40 millimeters.

7. A circular shaped seat cushion comprising:

a top fabric sheet;

a bottom fabric sheet;

a central fabric sheet;

a fluid containing bag having an oval shaped compartment at a center of the fluid containing bag and the fluid containing bag concentrically sewn to the central fabric sheet; and a sponge pad layered between the fluid containing bag and one of the top and bottom fabric sheets, wherein the top, bottom and central fabric sheets are sewn together about their peripheral edges.

8. The circular shaped seat cushion of claim 7, wherein the oval shaped compartment has a width of 86 millimeters and a length of about 106 millimeters, and the fluid containing bag includes a fluid filled to a level of about 5-40 millimeters.

9. The circular shaped seat cushion of claim 8, wherein the circular shaped seat cushion has an overall diameter of 300 millimeters.

* * * * *